US008993930B2

(12) United States Patent
Suzuki et al.

(10) Patent No.: US 8,993,930 B2
(45) **Date of Patent: *Mar. 31, 2015**

(54) COOKING DEVICE WITH ELECTRODES IN A LOWER FACE OF THE TOP PLATE

(75) Inventors: Hidekazu Suzuki, Hyogo (JP); Hiroyuki Katsube, Hyogo (JP); Kenzo Usui, Hyogo (JP); Taihei Oguri, Hyogo (JP); Kohei Kawata, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.
This patent is subject to a terminal disclaimer.

(21) Appl. No.: 13/394,366

(22) PCT Filed: Jan. 28, 2011

(86) PCT No.: PCT/JP2011/000493
§ 371 (c)(1),
(2), (4) Date: Mar. 6, 2012

(87) PCT Pub. No.: WO2011/093101
PCT Pub. Date: Aug. 4, 2011

(65) Prior Publication Data

US 2012/0167776 A1 Jul. 5, 2012

(30) Foreign Application Priority Data

Jan. 29, 2010 (JP) ..... 2010-018168
Jan. 29, 2010 (JP) ..... 2010-018170
Jan. 29, 2010 (JP) ..... 2010-018171
Jan. 29, 2010 (JP) ..... 2010-018172
Jan. 29, 2010 (JP) ..... 2010-018173

(51) Int. Cl.
*H05B 3/68* (2006.01)
*H05B 6/06* (2006.01)
*F24C 15/10* (2006.01)

(52) U.S. Cl.
CPC ..... *H05B 6/062* (2013.01); *F24C 15/102* (2013.01)
USPC ..... 219/209; 209/413; 209/494; 99/331

(58) Field of Classification Search
CPC ..... H05B 6/062; F24C 15/102
USPC ..... 219/620–622, 626, 209, 413, 494; 99/331
See application file for complete search history.

(56) References Cited

U.S. PATENT DOCUMENTS 4,446,350 A * 5/1984 Mizukawa et al. ..... 219/622
2009/0303201 A1 12/2009 Isoda et al.

(Continued)

FOREIGN PATENT DOCUMENTS

EP 0 429 120 A2 5/1991
EP 2 117 282 A1 11/2009

(Continued)

OTHER PUBLICATIONS

International Preliminary Report on Patentability for International Application No. PCT/JP2011/000493, dated Sep. 18, 2012, 8 pages.

(Continued)

*Primary Examiner* — Jianying Atkisson
(74) *Attorney, Agent, or Firm* — Brinks Gilson & Lione

(57) ABSTRACT

The cooking device includes a top plate on which a container is to be placed, heating devices provided below the top plate, electrodes provided in a lower face of the top plate and including a boiling-over detection parts placed near an outer periphery of a portion of the top plate positioned above the heating devices, contact parts for supplying an AC current to the boiling-over detection parts, and contact parts for connecting the contact parts and one-side ends of the boiling-over detection parts to each other, respectively, an electrode-use capacitance detection device for detecting changes in capacitance of the boiling-over detection parts, and a control device for controlling the heating devices based on changes in capacitance detected by the electrode-use capacitance detection device. The contact parts are provided at positions farther from the heating devices and on a more front side of the cooking device than the boiling-over detection parts, and the connection parts run through on the outer peripheral side of the boiling-over detection parts.

3 Claims, 7 Drawing Sheets

(56) References Cited

U.S. PATENT DOCUMENTS

| | | | |
|---|---|---|---|
| 2010/0096382 | A1 | 4/2010 | Sakakibara et al. |
| 2011/0309069 | A1 | 12/2011 | Fujinami et al. |

FOREIGN PATENT DOCUMENTS

| | | | |
|---|---|---|---|
| JP | 58-128691 | A | 8/1983 |
| JP | 61-243690 | A | 10/1986 |
| JP | 03-119683 | A | 5/1991 |
| JP | 2001-297864 | A | 10/2001 |
| JP | 2003-224459 | A | 8/2003 |
| JP | 2004-171855 | A | 6/2004 |
| JP | 2005-166392 | A | 6/2005 |
| JP | 2005-257202 | A | 9/2005 |
| JP | 2007-220388 | A | 8/2007 |
| JP | 2008-159494 | A | 7/2008 |
| JP | 2008-177010 | | 7/2008 |
| JP | 2009-099365 | A | 5/2009 |
| JP | 2009-218106 | A | 9/2009 |
| WO | WO 2008/084829 | A1 | 7/2008 |
| WO | WO 2008/090887 | A1 | 7/2008 |
| WO | WO 2010/079583 | A1 | 7/2010 |

OTHER PUBLICATIONS

Office Action in U.S. Appl. No. 13/394,280, entitled "Cooking Device," Kawata et al., dated May 3, 2013, 14 pages.
International Search Report for International Application No. PCT/JP2011/000490, dated May 17, 2011, 4 pages.
International Search Report for International Application No. PCT/JP2011/000491, dated May 10, 2011, 7 pages.
International Preliminary Report on Patentability for International Application No. PCT/JP2011/000490, dated Sep. 18, 2012, 8 pages.
International Preliminary Report on Patentability for International Application No. PCT/JP2011/000491, dated Sep. 18, 2012, 9 pages.
Office Action in corresponding Canadian Application No. 2,782,604, dated May 12, 2014, 3 pages.
Office Action in corresponding Canadian Application No. 2,782,605, dated May 14, 2014, 3 pages.
Office Action from counterpart Chinese Application No. 201180003697.2 with English translation of Search Report, dated Jul. 2, 2013, 8 pages.
Office Action from co-pending U.S. Appl. No. 13/394,280, dated Aug. 20, 2013, 7 pages.
Office action from Chinese Application No. 201180003698.7, dated Feb. 20, 2014 (with English translation of search report), 9 pages.
Office Action from Chinese Application No. 201180003697.2, dated Mar. 14, 2014 (with English translation of Search Report), 8 pages.
Office Action from Chinese Application No. 201180003696.8, dated Mar. 25, 2014 (with English translation of Search Report), 9 pages.
Extended European Search Report for European Application No. 11736814.2, dated Jan. 7, 2014, 6 pages.
Extended European Search Report for European Application No. 11736815.9, dated Jan. 7, 2014, 6 pages.
Extended European Search Report for European Application No. 11736816.7, dated Jan. 7, 2014, 6 pages.
Office Action in corresponding Canadian Application No. 2,782,606, dated Apr. 24, 2014, 2 pages.
International Search Report for International Application No. PCT/JP2011/000493, dated May 17, 2011, 4 pages.

* cited by examiner

COOKING DEVICE WITH ELECTRODES IN A LOWER FACE OF THE TOP PLATE

This application is a 371 application of PCT/JP2011/000493 having an international filing date of Jan. 28, 2011, which claims priority to JP2010-018173 filed Jan. 29, 2010, JP2010-018172 filed Jan. 29, 2010, JP2010-018171 filed on Jan. 29, 2010, JP2010-018170 filed Jan. 29, 2010 and JP2010-018168 filed Jan. 29, 2010, the entire contents of which are incorporated herein by reference.

TECHNICAL FIELD

The present invention relates to a cooking device having a top plate on which a container with liquid contained therein is to be placed.

BACKGROUND ART

In cooking devices having a top plate, conventionally, a circular- or polygonal-shaped electrode that surrounds a portion of the top plate for container placement (i.e., a portion positioned above a heating device for heating the container) is provided to detect liquid boiled over from the container, e.g. a pan, on the top plate (see PTL1).

PTL1: JP S61-243690 A

SUMMARY OF THE INVENTION

Technical Problem

For high-accuracy detection of boiled-over liquid based on a change in capacitance of the electrode, there is a need for detecting a small change in capacitance of the electrode caused by boiled-over liquid. However, due to differences in electrode resistance among a plurality of produced cooking devices, a small change in capacitance caused by boiled-over liquid may differ. For this reason, it has been the case that when liquid of equal quantity is boiled over from the container, some cooking devices execute control for stopping the heating of the container or lowering the heating output by the success of detecting the boiled-over liquid while others do not execute such control by the failure of detecting the boiled-over liquid.

Accordingly, an object of the invention is to provide a cooking device which is enabled to detect boiled-over liquid with high accuracy and with nearly equal accuracy among plural products of the cooking device.

Solution to Problem

In order to achieve the above object, the present invention has the following constitutions.

According to a first aspect of the present invention, there is provided a cooking device for heating a container comprising:

a ceramic top plate on which the container is to be placed;

a heating device provided below the top plate and serving for heating the container;

a conductor electrode provided in a lower face of the top plate and including a belt-like boiling-over detection part placed near an outer periphery of a portion of the top plate positioned above the heating device, a contact part for supplying an AC current to the boiling-over detection part, and a connection part for electrically connecting the contact part and one end of the boiling-over detection part to each other;

a capacitance detection device for supplying an AC voltage to the boiling-over detection part via the contact part to detect an increase or decrease in capacitance of the boiling-over detection part; and a control device for, upon detection of boiling-over of liquid from the container based on a change in capacitance detected by the capacitance detection device, decreasing electric power supplied to the heating device or stopping power supply, wherein the contact part of the electrode is provided at a position farther from the heating device and on a more front side of the cooking device than the boiling-over detection part, and the connection part runs through on an outer peripheral side of the boiling-over detection part so as to be connected to the contact part.

According to a second aspect of the present invention, there is provided the cooking device according to the first aspect of the present invention, wherein the connection part is set narrower in width than the boiling-over detection part and the contact part.

According to a third aspect of the present invention, there is provided the cooking device according to the first or second aspect of the present invention, wherein the boiling-over detection part includes a rear-side boiling-over detection part placed on a more rear side of the cooking device and a front-side boiling-over detection part placed on a more front side of the cooking device than the rear-side boiling-over detection part, so as to surround the portion of the top plate positioned above the heating device, and the connection part electrically connected to one end of the rear-side boiling-over detection part runs through on the outer peripheral side of the front-side boiling-over detection part.

Advantageous Effects of Invention

According to the present invention, the resistance value of the electrode can be inspected easily by using the contact part electrically connected to one end of the boiling-over detection part via the connection part as well as the other end of the boiling-over detection part. Therefore, it becomes implementable to produce a plurality of cooking devices generally equal in electrode resistance value thereamong. Further, the contact part and the connection part are farther from the heating device than the boiling-over detection part. Therefore, upon occurrence of boiling-over of the liquid from the container above the heating device, the contact part and the connection part do not largely change in capacitance as compared with the boiling-over detection part. For this reason, the liquid boiled over to a portion of the top plate positioned above the boiling-over detection part can be detected with high accuracy. Thus, produced plural cooking devices are enabled to detect boiling-over of the liquid with high accuracy and with generally equal accuracy thereamong.

BRIEF DESCRIPTION OF THE DRAWINGS

The above aspects and features of the present invention will become more apparent from the following description of preferred embodiments thereof with reference to the accompanying drawings, and wherein.

DETAILED DESCRIPTION OF THE PREFERRED EMBODIMENTS

Figure 1:
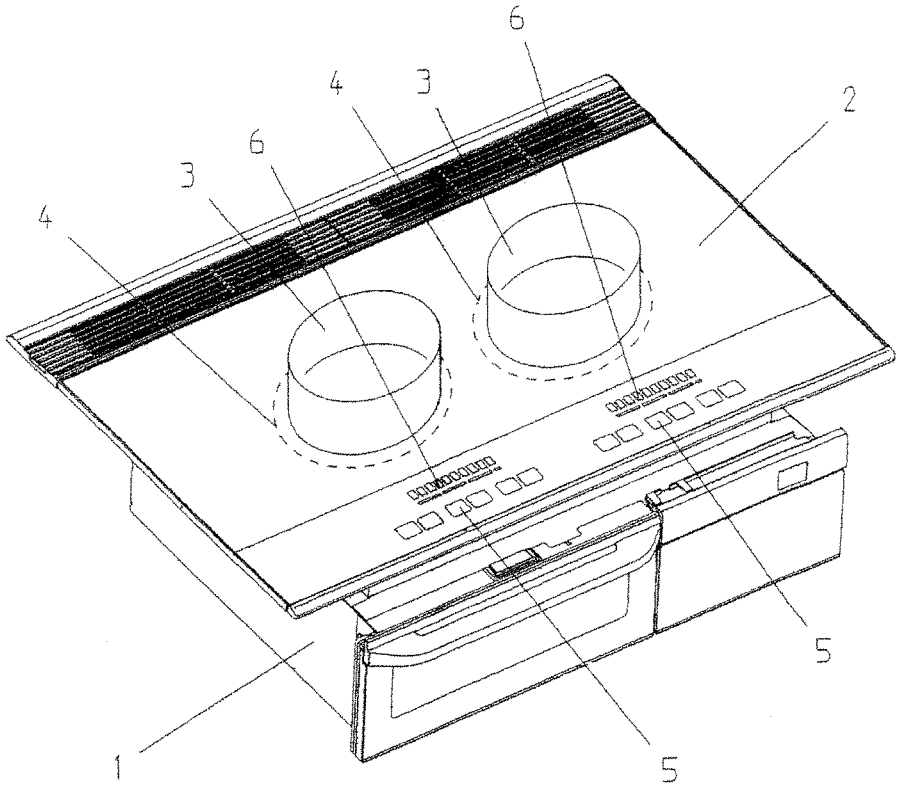
FIG. 1 is a perspective view of a cooking device according to Embodiment 1 of the present invention.

A first invention provides a cooking device for heating a container that comprising: a ceramic top plate on which the container is to be placed; a heating device provided below the top plate and serving for heating the container; a conductor electrode provided in a lower face of the top plate and including a belt-like boiling-over detection part placed near an outer periphery of a portion of the top plate positioned above the heating device, a contact part for supplying an AC current to the boiling-over detection part, and a connection part for electrically connecting the contact part and one end of the boiling-over detection part to each other; a capacitance detection device for supplying an AC voltage to the boiling-over detection part via the contact part to detect an increase or decrease in capacitance of the boiling-over detection part; and a control device for, upon detection of boiling-over of liquid from the container based on a change in capacitance detected by the capacitance detection device, decreasing electric power supplied to the heating device or stopping power supply, wherein the contact part of the electrode is provided at a position farther from the heating device and on a more front side of the cooking device than the boiling-over detection part, and the connection part runs through on an outer peripheral side of the boiling-over detection part so as to be connected to the contact part.

According to the first invention, the resistance value of the electrode can be inspected easily by using the contact part electrically connected to one end of the boiling-over detection part via the connection part as well as the other end of the boiling-over detection part. Therefore, it becomes implementable to produce a plurality of cooking devices generally equal in electrode resistance value thereamong. Further, the contact part and the connection part are farther from the heating device than the boiling-over detection part. Therefore, upon occurrence of boiling-over of the liquid from the container above the heating device, the contact part and the connection part do not largely change in capacitance as compared with the boiling-over detection part. For this reason, the liquid boiled over to a portion of the top plate positioned above the boiling-over detection part can be detected with high accuracy. Thus, produced plural cooking devices are enabled to detect boiled-over liquid with high accuracy and with generally equal accuracy thereamong.

In a second invention, the cooking device of the first invention is configured so that the connection part is set narrower in width than the boiling-over detection part and the contact part.

Since the connection part is set narrower in width than the boiling-over detection part, the boiling-over detection part more subserviently changes in capacitance, as compared with the connection part. Therefore, the liquid boiled over to the portion of the top plate positioned above the boiling-over detection part can be detected with even higher accuracy.

In a third invention, the cooking device of the first or second invention is configured so that the boiling-over detection part includes a rear-side boiling-over detection part placed on a more rear side of the cooking device and a front-side boiling-over detection part placed on a more front side of the cooking device than the rear-side boiling-over detection part, so as to surround the portion of the top plate positioned above the heating device, and the connection part electrically connected to one end of the rear-side boiling-over detection part runs through on the outer peripheral side of the front-side boiling-over detection part.

Since the connection part connected to the rear-side boiling-over detection part runs through on the outer peripheral side of the front-side boiling-over detection part, boiled-over liquid passes through above the front-side boiling-over detection part before reaching above the connection part. Then, the heating device is decreased in its heating output or stopped based on a change in capacitance of the front-side boiling-over detection part. Therefore, the boiled-over liquid is less likely to reach above the connection part, so that the connection part does not largely change in capacitance. Thus, it becomes implementable to detect boiled-over liquid based on a change in capacitance of the front-side or rear-side boiling-over detection part.

Hereinbelow, embodiments of the present invention will be described with reference to the accompanying drawings. It is noted that the invention is not limited by the following embodiments.

(Embodiment 1)

Figure 2:
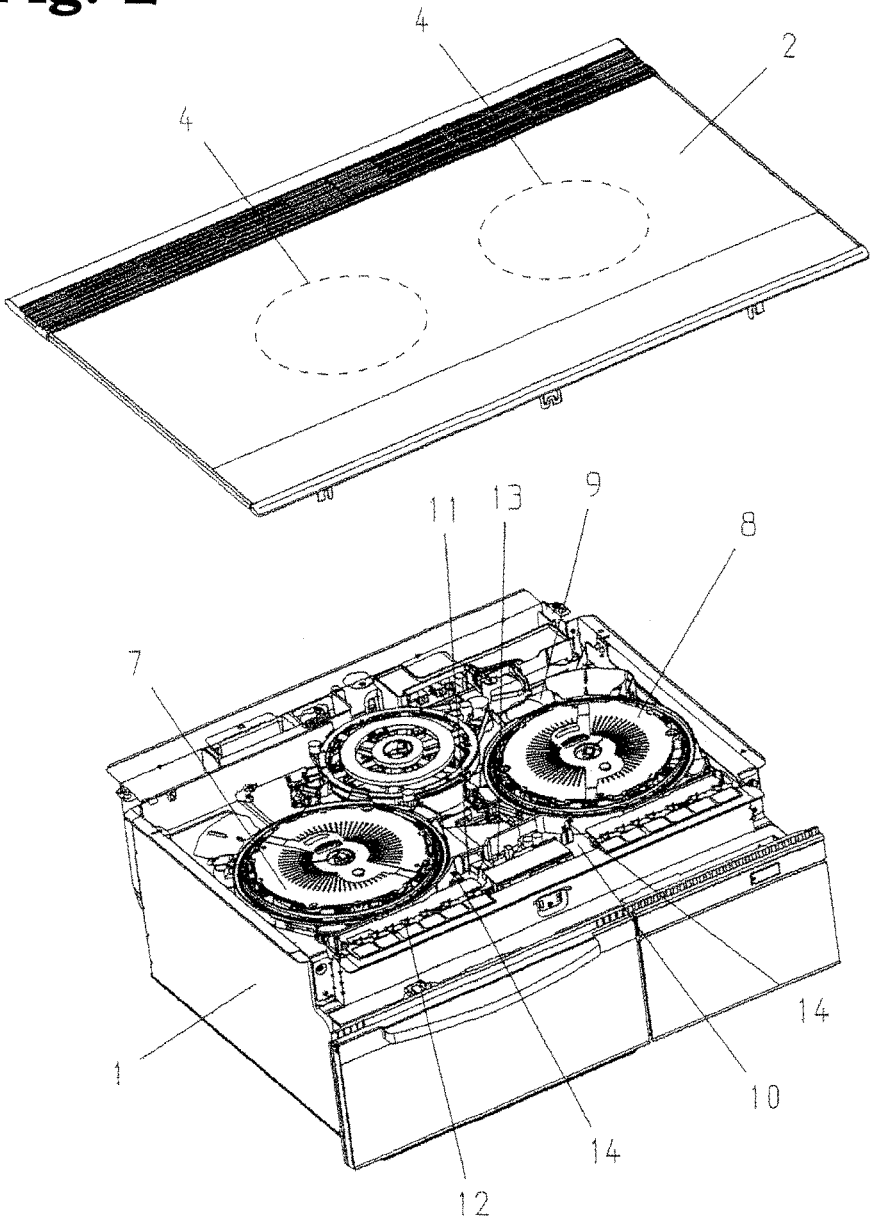
FIG. 2 is a perspective view showing a state in which the top plate is separated off in the cooking device according to Embodiment 1 of the invention.
Figure 3:
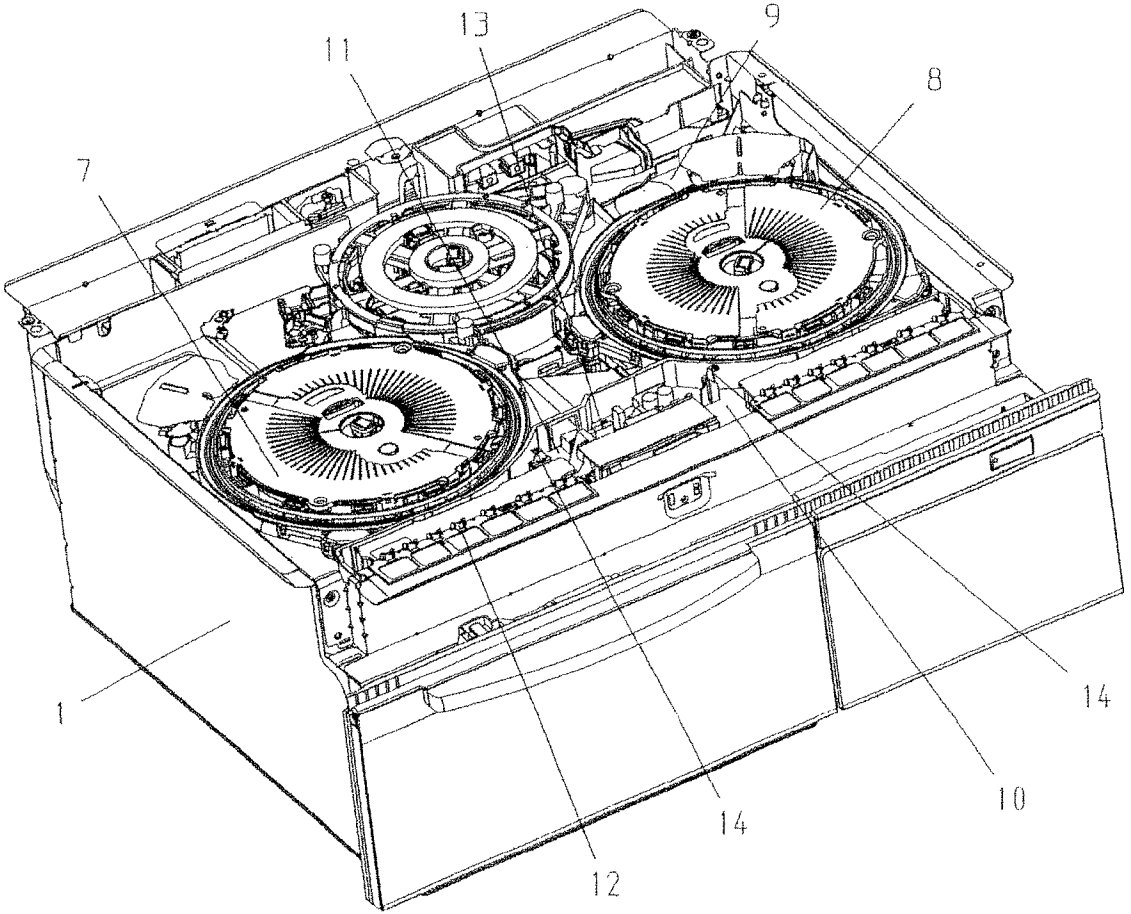
FIG. 3 is a perspective view showing a state in which the top plate is excluded in the cooking device according to Embodiment 1 of the invention.
Figure 4:
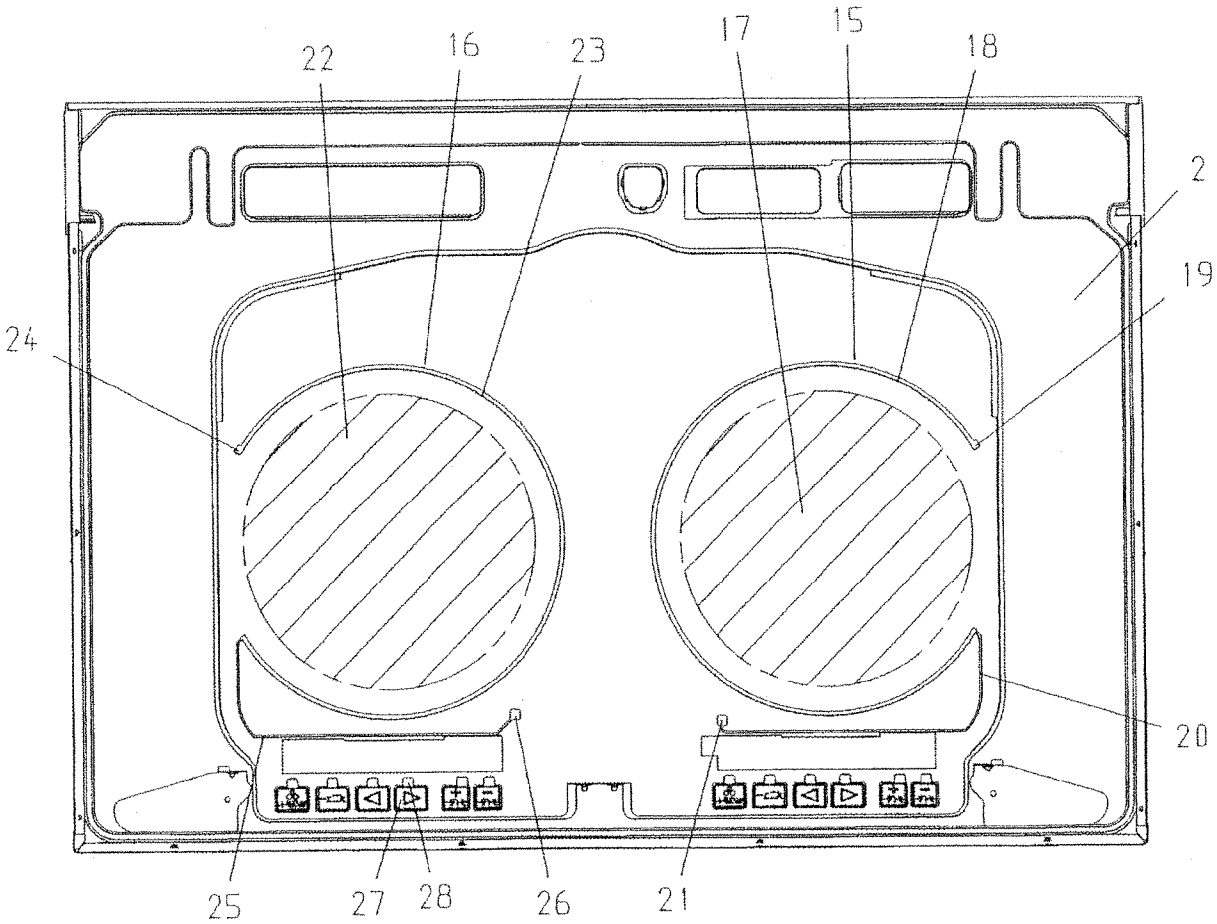
FIG. 4 is a view showing a lower face of the top plate in the cooking device according to Embodiment 1 of the invention.
Figure 5:
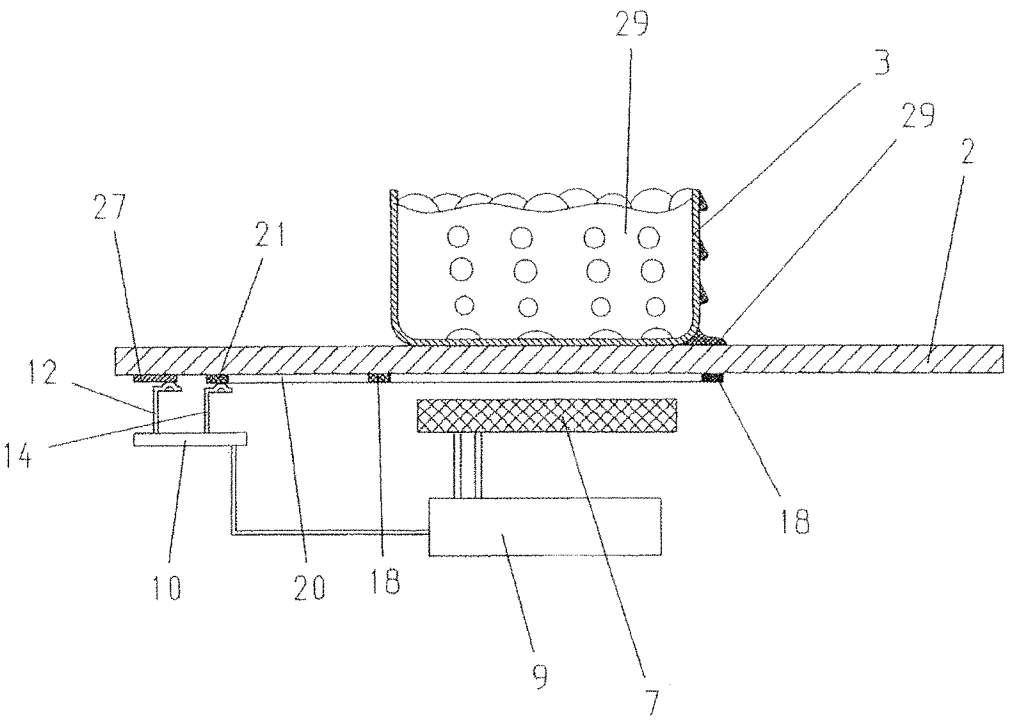
FIG. 5 is a sectional view of the cooking device according to Embodiment 1 of the invention.

FIG. 1 is a perspective view of a cooking device according to this embodiment. FIG. 2 is a perspective view showing a state in which the top plate is separated off in the cooking device according to this embodiment. FIG. 3 is a perspective view showing a state in which the top plate is excluded in the cooking device according to this embodiment. FIG. 4 is a view showing a lower face of the top plate in the cooking device according to this embodiment. Further, FIG. 5 is a sectional view showing a state in which the liquid is boiled over from the container on the cooking device according to this embodiment.

As shown in FIGS. 1 and 2, the cooking device has a body casing 1 having an opening in its upper part, and a ceramic top plate 2 covering the opening of the body casing 1. A heating position display part 4 for showing a position in which a pan or other container 3 is to be placed is provided in an upper face of the top plate 2. Also in the upper face of the top plate 2, an operation display part 5 for starting or stopping heating and a heating state display part 6 for displaying a heating state or the like are provided on the front side of the cooking device with respect to the heating position display part 4.

As shown in FIGS. 2 and 3, in the body casing 1, heating coils or other heating devices 7, 8 are provided below the heating position display part 4 of the top plate 2, and a control device 9 for controlling heating outputs of the heating devices 7, 8 is placed below the heating devices 7, 8.

The housing forming the outer profile of the body casing 1 is connected to the ground via a power cable.

Within the body casing 1, a display board 10 for showing a heating output or heating state is placed on the front side of the cooking device with respect to the heating devices 7, 8. The display board 10 is connected to the control device 9.

The display board 10 has LEDs, LCDs or the like that emit light based on a heating state. Light emission by these LEDs or LCDs makes it possible for the heating state display part 6 of the top plate 2 to display a heating state.

The display board 10 also includes an operation-use capacitance detection device 11, and the operation-use capacitance detection device 11 is connected to an operation-use connecting terminal 12. The operation-use capacitance detection device 11 supplies an AC voltage to the operation-use connecting terminal 12 to detect an increase or decrease in the capacitance of an operation-use electrode 27 connected to the operation-use connecting terminal 12.

The display board 10 further includes an electrode-use capacitance detection device 13, the electrode-use capacitance detection device 13 is connected to an electrode-use connecting terminal 14. The electrode-use capacitance detection device 13 supplies an AC voltage to later-described electrodes 15, 16 via the electrode-use connecting terminal 14 to detect an increase or decrease in capacitance of the electrodes 15, 16. The electrode-use capacitance detection device 13 further transmits a signal based on a capacitance detection result to the control device 9.

As shown in FIG. 4, the electrodes 15, 16 are provided in a lower face of the top plate 2. The electrodes 15, 16 are formed by printing carbon on the lower face of the top plate 2. Instead, electrodes 15, 16 of preformed thin copper plates may also be bonded to the lower face of the top plate 2.

The electrode 15 includes: a belt-like boiling-over detection part 18 which is placed near an outer periphery of a portion of the lower face of the top plate 2 shown by an area 17, the portion being positioned above the heating device 7 so as to face the heating device 7 and being generally identical in shape to an upper face of the heating device 7, and which is formed into a generally arc shape extending along the outer periphery of the area 17; an inspection point part 19 provided at one end of the boiling-over detection part 18 and being larger in width than the boiling-over detection part 18; a connection part 20 having one end connected to the other end of the boiling-over detection part 18; and a contact part 21 provided at the other end of the connection part 20.

The contact part 21 of the electrode 15 is provided at a position which is farther from the heating device 7 (area 17) and on the more front side of the cooking device than the boiling-over detection part 18.

The connection part 20 of the electrode 15 runs through on the outer peripheral side of the boiling-over detection part 18 (i.e., through a part farther from the area 17 than the boiling-over detection part 18) so that the other end of the boiling-over detection part 18 and the contact part 21 are electrically connected to each other. The connection part 20 is set narrower in width than the boiling-over detection part 18, the inspection point part 19 and the contact part 21.

With the electrode 15 as shown above, when liquid (cooking object) 29 within the container 3 is boiled over on the top plate 2 due to heating by the heating device 7 as shown in FIG. 5, the boiling-over of the liquid 29 occurs at or near a portion of the top plate 2 positioned above the boiling-over detection part 18.

Similarly, the electrode 16 includes: a belt-like boiling-over detection part 23 which is placed near an outer periphery of an area 22 positioned above the heating device 8 and which is formed into a generally arc shape extending along the outer periphery of the area 22; an inspection point part 24 provided at one end of the boiling-over detection part 23 and being larger in width than the boiling-over detection part 23; a connection part 25 connected to the other end of the boiling-over detection part 23; and a contact part 26 provided at the other end of the connection part 25.

The contact part 26 of the electrode 16 is provided at a position which is farther from the heating device 8 (area 22) and on the more front side of the cooking device than the boiling-over detection part 23.

The connection part 25 of the electrode 16 runs through on the outer peripheral side of the boiling-over detection part 23 (i.e., through a part farther from the area 22 than the boiling-over detection part 23) so that the other end of the boiling-over detection part 23 and the contact part 26 are electrically connected to each other. The connection part 25 is set narrower in width than the boiling-over detection part 23, the boiling-over detection part 18, the inspection point part 24 and the contact part 26.

With the electrode 16 as shown above, boiling-over of liquid boiled over from the container 3 heated by the heating device 8 occurs at or near a portion of the top plate 2 positioned above the boiling-over detection part 23.

In addition, a material having wear resistance, thermal resistance and/or insulative property may be printed on surfaces of the boiling-over detection parts 18, 23 and the connection parts 20, 25. By doing so, time changes in resistance and capacitance of the electrodes 15, 16 or their damage due to rubbing during assembling work can be suppressed.

Moreover, the operation-use electrode 27 is provided at a portion of the lower face of the top plate 2 positioned below the operation display part 5. An auxiliary electrode 28 is part of the operation-use electrode 27.

With the top plate 2 set on the body casing 1, the contact part 21 of the electrode 15 and the contact part 26 of the electrode 16 are brought into contact with two electrode-use connecting terminals 14, respectively.

Further, with the top plate 2 set on the body casing 1, the auxiliary electrode 28 is brought into contact with the operation-use connecting terminal 12.

With regard to the cooking device according to this embodiment as described above, its operations and functions will be described below.

When a user sets the container 3, for example, to a portion of the top plate 2 shown by the heating position display part 4 provided on the area 17 in opposition to the area 17 and then presses a button for heating start in the operation display part 5 on the heating device 7 side, the operation-use electrode 27 changes in capacitance. Then, the change in capacitance is transferred as a change in voltage to the operation-use connecting terminal 12 being in contact with the auxiliary electrode 28 of the operation-use electrode 27. Based on the voltage change of the operation-use connecting terminal 12, the operation-use capacitance detection device 11 recognizes a button press by the user, transmitting a signal for heating start to the control device 9. It is noted that the container 3 is, for example, a pan containing the liquid 29 such as water.

According to the signal, the control device 9 controls electric power supply for the heating device 7, so that the heating device 7 starts heating of the container 3. This heating causes the liquid 29 in the container 3 to increase in temperature. With a strong heating output of the heating device 7, the liquid 29 is boiled so as to be boiled over out of the container 3.

The boiled-over liquid 29 flows on the outer surface of the container 3 to a portion of the top plate 2 around the container 3. As the liquid 29 flows to the portion of the top plate 2 positioned above the boiling-over detection part 18 of the electrode 15, the capacitance of the boiling-over detection part 18 changes under influence by the liquid 29.

The electrode-use capacitance detection device 13 connected to the electrode 15 via the electrode-use connecting terminals 14 decides that during heating of the container 3, the liquid 29 is being boiled over from the container 3 when a variation (increment or decrement) of the capacitance of the boiling-over detection part 18 in the electrode 15 has exceeded a specified quantity. After the decision, the electrode-use capacitance detection device 13 transmits, to the control device 9, a signal for decreasing the heating output of the heating device 7 or a signal for stopping the heating device 7. The control device 9, having received the signal, decreases the heating output of the heating device 7 or stops the heating device 7.

More strictly, the electrode-use capacitance detection device 13 detects changes in capacitances of the boiling-over detection part 18 and the connection part 20, respectively and independently, via the electrode-use connecting terminals 14.

When the liquid is boiled over from the container 3 on the area 17, the connection part 20, which is farther from the area 17 than the boiling-over detection part 18, is subject to less changes in capacitance than the boiling-over detection part 18. Also, the boiling-over detection part 18, which is larger in width than the connection part 20, is subject to changes in capacitance more sensitively than the connection part 20. Therefore, it can be regarded that the electrode-use capacitance detection device 13 detects changes in capacitance of the boiling-over detection part 18. As a result of this, the liquid 29 boiled over to the portion of the top plate 2 positioned above the boiling-over detection part 18 can be detected with high accuracy.

For a supplementary explanation, the inspection point part 19 of the electrode 15, which is provided at an end of the electrode 15, is smaller in capacitance than the boiling-over detection part 18. Also, the contact part 21, which is placed at a position separate from the heating device 7 (area 17 positioned upward thereof) on the front side of the cooking device, shows less change in capacitance than the boiling-over detection part 18 even if the container 3 is offset from the center of the area 17.

The description given hereinabove has been made on an example in which the container 3 is heated by the heating device 7. However, the case is the same also when the container 3 is heated by the heating device 8.

Further, since the electrode-use capacitance detection device 13 decides that the liquid 29 is being boiled over from the container 3 when a variation (increment or decrement) of the capacitance of the electrodes 15, 16 has exceeded a specified quantity, there is a need for detecting such changes in capacitance with high accuracy. For this purpose, resistance values of the electrodes 15, 16 each need to be not more than a predetermined resistance value.

With considerations given to production variations, in order to obtain a top plate 2 in which the electrodes 15, 16 have resistance values within a predetermined range, it is desirable to inspect the resistance values of the electrodes 15, 16 in all of produced plural top plates 2. For facilitation of the inspection, the electrodes 15, 16 have, at their two ends, the inspection point parts 19, 24 and the contact parts 21, 26. Resistance values of the electrodes 15, 16 can be measured easily by bringing an inspection device (e.g., tester bar of a tester) for use of resistance value measurement into contact with the inspection point parts 19, 24 and the contact parts 21, 26. As a result of this, there can be achieved a cooking device in which resistance values of the electrodes 15, 16 are within a predetermined range. Thus, it becomes implementable to produce a plurality of cooking devices having high detection accuracy for boiled-over liquid 29 and being generally equal in detection accuracy thereamong.

In addition, the inspection point part 19 of the electrode 15 and the inspection point part 24 of the electrode 16 need only to be so sized (e.g., 5 millimeters in width) that an tip (tester bar of a tester) of the inspection device can be brought into contact therewith. Besides, ends of the boiling-over detection parts 18, 23 may also be used as the inspection point parts.

Further, after the inspection for the resistance values of the electrodes 15, 16, portions of the electrode 15 other than the contact part 21 as well as portions of the electrode 16 other than the contact part 26 may be coated with insulative coating film. As a result of this, changes in resistance values of the electrodes 15, 16 due to condensation can be suppressed.

(Embodiment 2)

Figure 6:
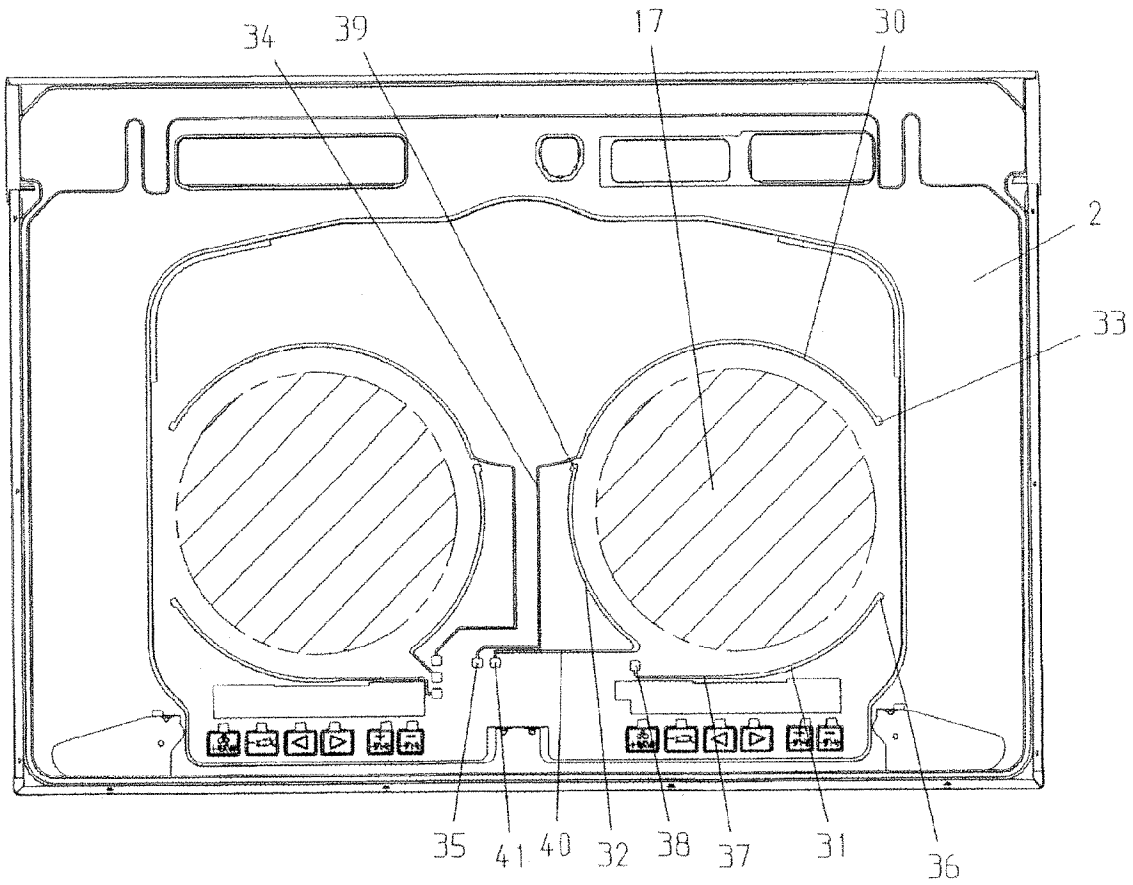
FIG. 6 is a view showing a lower face of the top plate in a cooking device according to Embodiment 2 of the invention.
Figure 7:
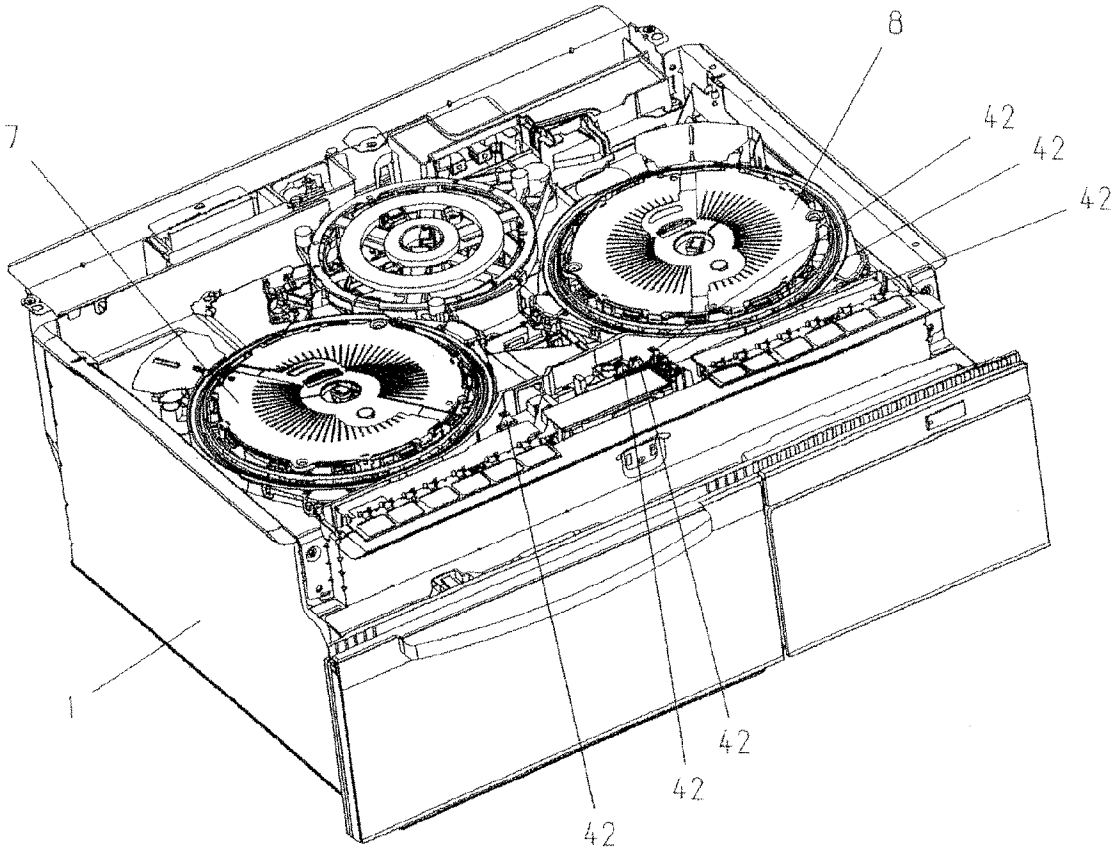
FIG. 7 is a perspective view showing a state in which the top plate is excluded in the cooking device according to Embodiment 2 of the invention.

FIG. 6 is a view showing a lower face of the top plate 2 in a cooking device according to this embodiment. FIG. 7 is a perspective view showing a state in which the top plate 2 is excluded in the cooking device according to this embodiment.

It is noted that description of the same component members as in Embodiment 1 is omitted and differences therefrom only will be described below. Further, the same component members as in Embodiment 1 are designated by the same reference signs. Since the heating device 7 and the heating device 8 are of the same constitution, only the heating device 7 will be described below.

As shown in FIG. 6, a plurality of boiling-over detection parts are provided near the outer periphery of a portion of the lower face of the top plate 2 which is positioned above the heating device 7 in opposition to the heating device 7 and which is shown by an area 17 of the top plate 2 generally identical in shape to the upper face of the heating device 7.

A boiling-over detection part 30 is provided on a more rear side of the cooking device than the area 17, a boiling-over detection part 31 is provided on a more front side of the cooking device than the area 17, and a boiling-over detection part 32 is provided on a more central side of the cooking device than the area 17.

The boiling-over detection part 30 is formed into a belt-like, generally arc shape placed near the outer periphery of the area 17 and extending along the outer periphery of the area 17. An inspection point part 33 larger in width than the boiling-over detection part 30 is provided at one end of the boiling-over detection part 30. The other end of the boiling-over detection part 30 is electrically connected via a connection part 34 to a contact part 35 positioned on the more front side of the cooking device than the area 17.

The boiling-over detection part 31 is formed into a belt-like, generally arc shape placed near the outer periphery of the area 17 and extending along the outer periphery of the area 17. An inspection point part 36 larger in width than the boiling-over detection part 31 is provided at one end of the boiling-over detection part 31. The other end of the boiling-over detection part 31 is electrically connected via a connection part 37 to a contact part 38 positioned on the more front side of the cooking device than the area 17.

The boiling-over detection part 32 is formed into a belt-like, generally arc shape placed near the outer periphery of the area 17 and extending along the outer periphery of the area 17. An inspection point part 39 larger in width than the boiling-over detection part 32 is provided at one end of the boiling-over detection part 32. The other end of the boiling-over detection part 32 is electrically connected via a connection part 40 to a contact part 41 positioned on the more front side of the cooking device than the area 17.

Electrode-use connecting terminals 42 shown in FIG. 7 is connected to the electrode-use capacitance detection device 13. With the top plate 2 set on the body casing 1, the contact parts 35, 38, 41 are individually brought into contact with the electrode-use connecting terminals 42.

Since a plurality of boiling-over detection parts 30, 31, 32 are provided for one heating device as shown above, it becomes possible to shorten the boiling-over detection parts 30, 31, 32, individually. Also, as in the case of the boiling-over detection parts 30, 31, 32, the shorter the boiling-over detection parts become, the smaller their resistance values become while the larger the variations of their capacitances caused by the boiled-over liquid 29 become. Therefore, it becomes implementable to detect smaller quantities of boiled-over liquid 29 or to discriminate types of the boiled-over liquid. As a result of this, the heating device 7 can be stopped or the heating output of the heating device 7 can be decreased immediately when the liquid 29 is boiled over from the container 3 onto the top plate 2. Otherwise, even upon detection of a change in capacitance, observing the degree of the change in capacitance or time changes in capacitance makes it possible to discriminate that it is no boiling-over, in which case unnecessary suppression of the heating output or stop of the heating operation can be avoided.

The connection part 34 connected to the boiling-over detection part 30 placed on the rear side of the cooking device is longer than the connection parts 37, 40 connected to the other boiling-over detection parts 31, 32, so that the boiled-over liquid 29 more likely deposits to a portion of the top plate 2 positioned above the connection part 34. Therefore, the connection part 34 is more likely to significantly affect capacitance changes of the boiling-over detection parts 31, 32.

As a solution to this, the connection part 34 is placed on the outer peripheral side (one side farther from the area 17) of the boiling-over detection part 32. The boiled-over liquid 29 passes through above the boiling-over detection part 32 before reaching above the connection part 34. Due to this, the heating device 7 can be decreased in its heating output or stopped based on the change in capacitance of the boiling-over detection part 32. As a result, influence of the presence of the connection part 34 on the boiling-over detecting operation on can be reduced. Thus, based on changes in capacitance of the boiling-over detection parts 30, 31, 32, boiling-over of the liquid 29 can be detected with good accuracy and with stable sensitivity independent of boiling-over directions.

Although the present invention has been fully described in connection with the preferred embodiments thereof with reference to the accompanying drawings, it is to be noted that various changes and modifications are apparent to those skilled in the art. Such Changes and modifications are to be understood as included within the scope of the present invention as defined by the appended claims unless they depart therefrom.

The entire disclosure of Japanese Patent Applications No. 2010-018168, No. 2010-018170, No. 2010-018171, No. 2010-018172 and No. 2010-018173 all filed on Jan. 29, 2010, including specification, claims, drawings, and summary are incorporated herein by reference in its entirety.

Industrial Applicability

As described hereinabove, the present invention makes it implementable to produce a plurality of cooking devices capable of detecting boiling-over of liquid from the container with high accuracy and with generally equal accuracy thereamong. This invention, even with a plurality of electrodes provided as shown in FIG. 6, also makes it implementable to inspect resistance values of the electrodes in short time with ease, so that the invention is practicable not only to household- or business-use but also cooking devices of various designs. Besides, in addition to detection of boiling-over of the liquid, the electrodes are usable also for detection of not boiling-over but shifts of the container by the user.

The invention claimed is:

1. A cooking device for heating a container comprising:

a ceramic top plate on which the container is to be placed;

a heating device provided below the top plate and serving for heating the container;

a conductor electrode provided in a lower face of the top plate, the conductor electrode including:

an arc-shaped belt-like boiling-over detection part placed near and extending continuously along an outer periphery of a portion of the top plate, said portion positioned above the heating device and generally corresponding in shape to an upper face of the heating device, the boiling-over detection part having a proximal end and a distal end relative to a contact part, the contact part for supplying an AC current to the boiling-over detection part, and a connection part for electrically connecting the contact part and the proximal end of the boiling-over detection part to each other;

a capacitance detection device for supplying an AC voltage to the boiling-over detection part via the contact part to detect an increase or decrease in capacitance of the boiling-over detection part; and a control device for, upon detection of boiling-over of liquid from the container based on a change in capacitance detected by the capacitance detection device, decreasing electric power supplied to the heating device or stopping power supply, wherein the contact part of the electrode is provided at a position farther from the heating device than the boiling-over detection part, and the connection part runs through on an outer peripheral side of the boiling-over detection part so as to be connected to the contact part.

2. The cooking device according to claim 1, wherein the connection part is set narrower in width than the boiling-over detection part and the contact part.

3. The cooking device according to claim 1, wherein the conductor electrode includes a rear-side electrode having a rear-side boiling-over detection part placed on a more rear side of the cooking device and a central side electrode having a central-side boiling-over detection part placed on a more central side of the cooking device than the rear-side boiling-over detection part, and a connection part electrically connected to a proximal end of the rear-side boiling-over detection part runs through on the outer peripheral side of the central-side boiling-over detection part.

* * * * *

UNITED STATES PATENT AND TRADEMARK OFFICE

CERTIFICATE OF CORRECTION

PATENT NO. : 8,993,930 B2
APPLICATION NO. : 13/394366
DATED : March 31, 2015
INVENTOR(S) : Hidekazu Suzuki et al.

It is certified that error appears in the above-identified patent and that said Letters Patent is hereby corrected as shown below:

In the Title Page

Item (56), "References Cited", under "U.S. PATENT DOCUMENTS", insert the following:

--US 2008/0099449 A1 5/2008 England et al.
US 2010/0187216 A1 7/2010 Komada et al.--.

Item (56), "References Cited", under "OTHER PUBLICATIONS", insert the following:

--Office Action in related U.S. Application No. 13/394,365, dated February 2, 2015, 6 pages.--.

Signed and Sealed this
Twenty-sixth Day of July, 2016

Michelle K. Lee

Michelle K. Lee
*Director of the United States Patent and Trademark Office*